United States Patent [19]

Wright

[11] 4,027,879

[45] June 7, 1977

[54] TENNIS TRAINING DEVICE

[76] Inventor: Bruce David Wright, 96 Longhill St., Springfield, Mass. 01108

[22] Filed: Apr. 21, 1975

[21] Appl. No.: 569,829

[52] U.S. Cl. ..... 273/29 A; 273/183 D

[51] Int. Cl.[2] ..... A63B 69/38

[58] Field of Search ..... 273/29 A, 81 R, 81 A, 273/81 B, 81 C, 81 D, 81.3, 80 C, 26 B, 72 R, 72 A, 63 E, 75, 68, 183 D, 81.2, 162 R, 186 R, 186 A, 186 D

[56] References Cited

UNITED STATES PATENTS

| | | | |
|---|---|---|---|
| 2,044,567 | 6/1936 | Daday | 273/81 R |
| 2,099,521 | 11/1937 | Herkimer et al. | 273/72 R |
| 3,173,688 | 3/1965 | Green | 273/72 |
| 3,572,706 | 6/1969 | Schroder | 273/26 B |
| 3,834,714 | 9/1974 | Smolinski | 273/183 D |
| 3,931,968 | 1/1976 | Hedgeberg | 273/81.2 |

*Primary Examiner*—Harland S. Skogquist
*Assistant Examiner*—T. Brown
*Attorney, Agent, or Firm*—Ross, Ross & Flavin

[57] ABSTRACT

A training device used to instruct the student of tennis in developing a proper grip in connection with proper forehand and backhand swinging, service, volley or overhead strokes in which the execution of an imperfect swing resultant from insufficient gripping strength of the hand is accompanied by a noise and vibrant sensation to the trainee. The training device has an easily deformable elongated hand grip portion having an elongated shaft loosely extending along the longitudinal axis thereof. A pair of spaced apart slide collars are placed within the hand grip and loosely surround the shaft. One end of the shaft is provided with a stop knob while the other end of the shaft has a neck member attached thereto. When in a normal position, the stop knob is spaced from one of the slide collars and the neck member abuts one end of the hand grip. When a user grips the handle grip portion with a proper grip force while swinging the device during simulation of any of the usual tennis stroke motions the neck portion will remain in its normal position, however, if the grip force is improper the neck member will move away from the end of the grip member and the stop knob will contact a slide collar, therefore a visual and audible indication will be observed, signaling improper hand grip of the grip member.

1 Claim, 3 Drawing Figures

TENNIS TRAINING DEVICE

BACKGROUND OF THE INVENTION

In tennis, it has become recognized that the tennis racket shall be gripped in different positions for different types of strokes. Basically the strokes may be divided into forehand and backhand, service, volley and overhead strokes. In teaching tennis to a beginner, it is necessary to instruct the student how to hold the racket for a forehand stroke and how to hold the racket for a backhand stroke with modifications for the other types of strokes as well. While it is possible to provide this instruction, it is quite difficult for the student to carry out the instructions during play. It is not possible during a game of tennis to look at the racket and the position of the hand thereon because the player must at all times keep his eye on the tennis ball in order that he will be in the proper position to hit the ball returned by his opponent. Thus, it is necessary for a player to automatically switch his grip upon the racket during play.

The accepted swing of a tennis racket is a motion wherein the momentum of the head of the tennis racket is used to propel the tennis ball. Instructors in the art of playing tennis go to great lengths to impart to their students the kinesthetic or muscular sense which must be developed in using the racket as a centrifugal implement to impact a tennis ball. Unfortunately, this kinesthetic or muscular sense is personal to the student. In many cases, verbal stimuli or visual imitation of an instructor are very inefficient. The student in trying to swing at a tennis ball inadvertently continues to form undesirable habits. The result is a tennis stroke which uses large amounts of energy, is physically tiring to the player, and develops an erratic stroke in which the direction of the tennis ball is hard to control.

It is a principal object of this invention to provide a tennis training device which furnishes the student with a physically detectable and visually apparent indication of incorrect tennis racket swing with respect to the proper amount of grip squeezing strength on the handle.

The degree of tightness with which one squeezes the grip of a racket during the period of acceleration toward the oncoming ball, at the moment of impact, and during the period of the follow-through of any stroke determines to a significant extent the control and power of that stroke.

An advantage of this invention is that the student can both feel and observe immediately the effect of an insufficient amount of force of grip squeeze during the tennis swing.

Yet another advantage of this invention is that the presence of an instructor is often wholly unnecessary in the development of a correct tennis swing.

In playing tennis, the player connot be constantly checking his racket to assure that the position of his hand on the racket handle is proper during each stroke. He must keep a very firm grip on the racket handle to counteract the considerable centrifugal forces of a fast stroke, for example, a serve or to counteract the torque resulting from the ball engaging the opposite end of the racket.

The invention hereof addresses itself to these problems of proper and improper grip during the performance of any stroke motion.

It is quite usual to strike a ball with the racket head at a substantial radial distance from the longitudinal axis of the handle, which will produce a torque tending to rotate the handle within the player's grip. The conventional tennis racket handle is somewhat rounded, which shape when combined with a slippery grip resulting from perspiration will commonly result in relative rotation between the handle and player's hand under the influence of this torque.

In the forehand stroke of tennis, the torque produced by the force of the ball striking the racket head and the moment arm from the striking point to the forefinger of the player's hand tends to rotate the racket about a generally vertically extending axis passing through the gripping forefinger to separate the end of the racket handle from the player's palm portion that is adjacent the little finger. This results in a tendency to weaken the stroke and can be counteracted only by a tight and strong grip upon the handle.Also, a ball hitting the strings or edge of the racket to the side of center will cause the handle of the racket to rotate in the user's hand.

Individual preferences will change the angle of the hand with respect to the longitudinal axis of the handle for a player's own conventional grip. In any event, the purpose hereof is to teach the player the correct degree of pressure. to be exerted by him upon his grip regardless of the type of grip he may conveniently and naturally expound.

The conventional tennis racket handle does not have a fixed reference for circular orientation or for the axial position of the racket relative to the hand, so that the player depends merely on the subjective feeling of the grip for holding the racket always in the same position. In addition, the forehand stroke is considered by many players to be basically unstable. This instability is generated by the limited load carrying capability of the hand in the forehand stroke condition, as partially explained above. The circumference of the cross-section of a conventional racket handle averages about 4½ inches. With the fingers and the thumb wrapped around the handle, the grip around the outer portion of the hand is strong and stable since the forefinger and thumb together can overlap the whole circumference of the handle; however, the grip is weaker and therefore is unstable at the inner portion of the hand defined by the little finger, because the little finger alone cannot overlap the circumference of the handle. Consequently, the grip can loosen and open a gap between the palm and the handle at the inner region of the hand during a forehand stroke, which concentrates the reaction force of the axial moment on the little finger.

SUMMARY OF THE INVENTION

The device of this invention, called a "Tech-ni-grip", enables a player to train himself as to the proper type of grip to be applied to a racket and the proper moment of such application, all to the end that he is enabled to develop not only a greater forearm strength, but also the proper timing necessary to apply grip firmness during the most critical phase of each stroke, be it service, groundstroke, volley or overhead.

The invention comprehends a tell-tale means in connection with a player's use of a racket and is designed for utilization in the correct development of the player's strokes in his off-the-court form of practice.

In actual use called the player's "practice session", the correct motion in connection with any stroke is desirably performed in a rhythmical pantomime of that stroke as the player would encounter it in on-the-court conditions and in the event of an improper application of gripping force during that practice session the player is signalled so that he is enabled to know when he is performing incorrectly, obviously to the end that he may correct his own errors.

One salient advantage is that with this learning tool, the player is spared a contention with the greatest single variable in the game of tennis, the ball, and he is enabled to concentrate on the mechanics of a proper or correct stroke for a given situation. Thereby he is enabled to form and develop correct habits of motion that will serve him in good stead in actual play situations.

According to the invention hereof, if one does not squeeze a yieldable handle or grip at the proper moment and/or with the requisite degree of force, that yieldable handle or grip will not impinge upon an inner shaft about which that handle or grip circumscribes, thereby leading directly to an immobilization of the training tool. A plastic neck will thrust forwardly from its friction-held position and with a definite cracking sound such as to signal to the player that a proper degree of grip firmness has not been applied through the necessary period of his simulated stroke.

Broadly, the invention comprises a grip having a longitudinal bore therein with means within the bore for releasably holding a movable element relative to the grip so long as the grip is properly grasped by the trainee during a practice swing or stroke but for dislodging the movable element and causing same to travel relative to the grip a certain distance at the terminus of which it is stopped with a resulting sound and sensible vibration when and as the grip is improperly grasped.

The invention will comfortably fit any proportionally normal adult hand or the hand of any child of tennis playing age by its proper geometry and allows the simulation of a definite orientation of a racket to the hand and which will carry all of the axial load due to the centrifugal force of the strokes.

DESCRIPTION OF PREFERRED EMBODIMENT

Figure 1:
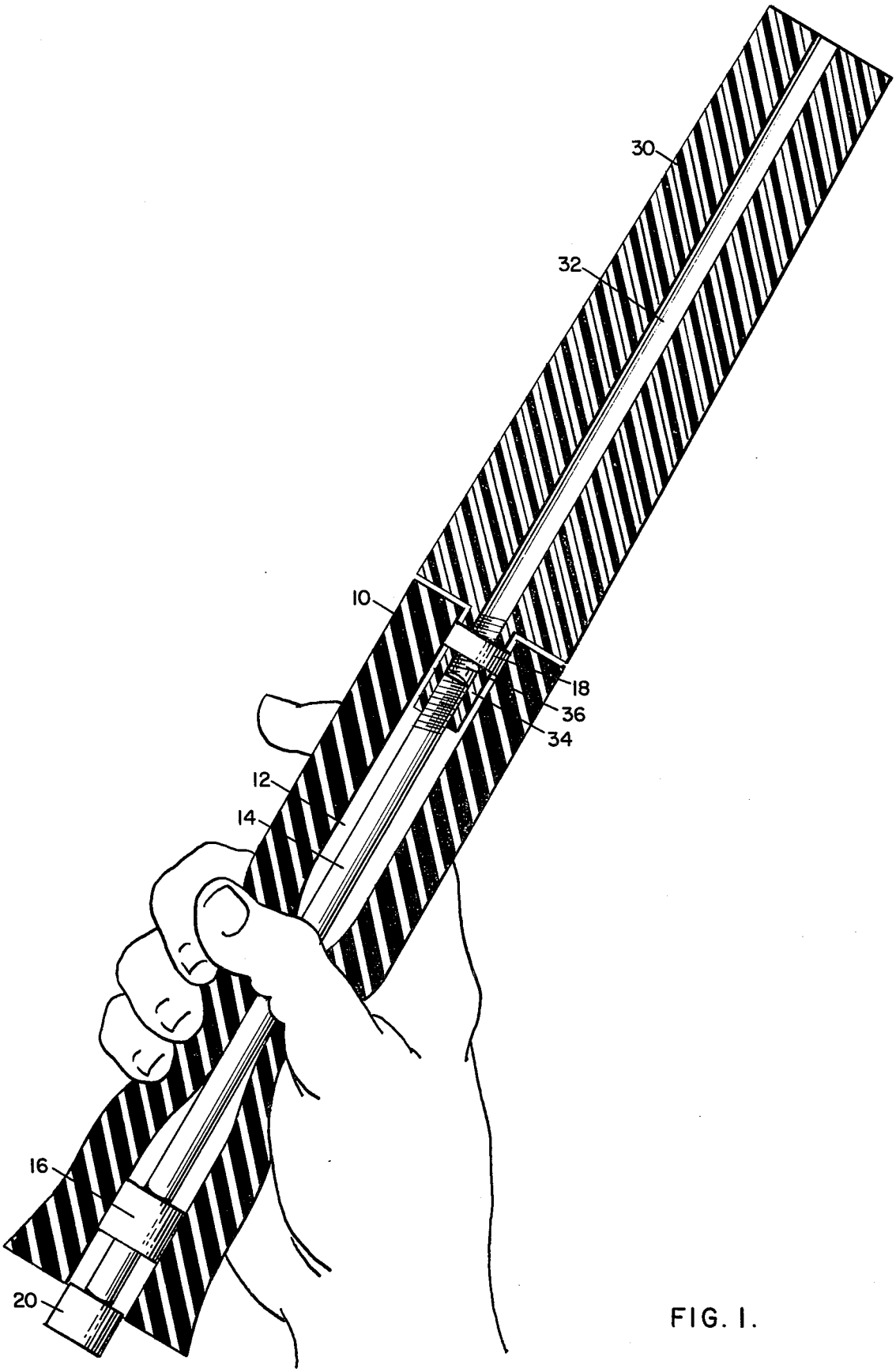
FIG. 1 is a view in section showing the hand held device of the invention and illustrating a sufficient grip tightness to cause the handle to impinge on the shaft, thus immobilizing same.
Figure 3:
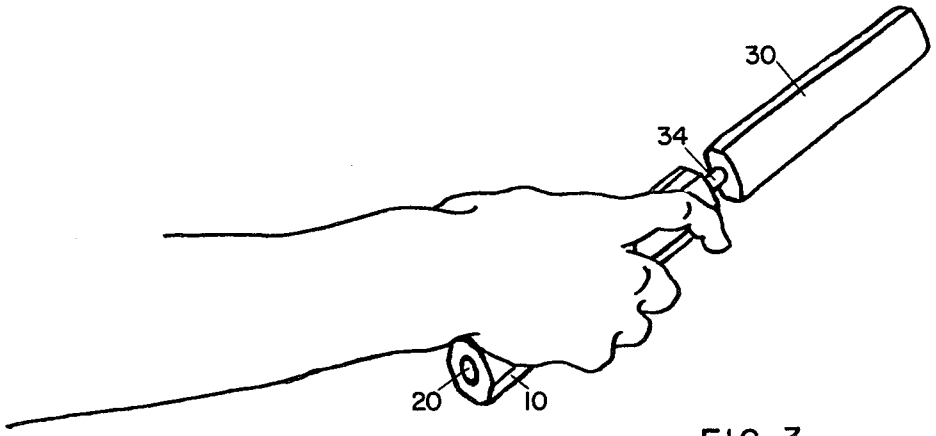
FIGS. 2 and 3 are drawings showing the device as held by the player's hand in actual use in the positions respectively where the grip has been improperly applied during the swing from the FIG. 2 to FIG. 3 positions in a forehand stroke motion and thus the telltale position of FIG. 3.
Figure 2:
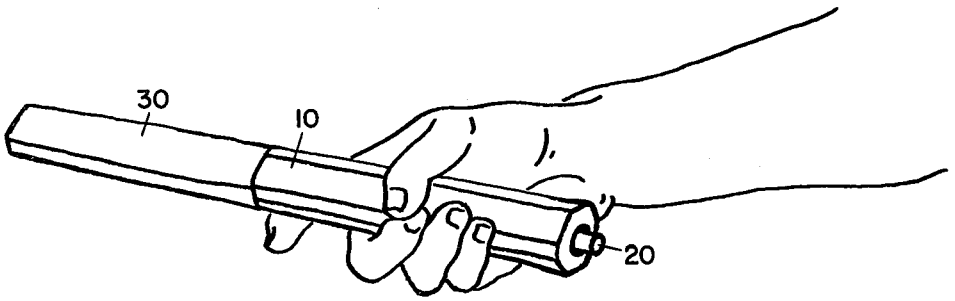

In the drawings, the preferred embodiment of the invention is illustrated as a single unit identified primarily, as one views the same from a distance, as inclusive of an inboard handle or grip 10 and an outboard neck 30 associated therewith and extending longitudinally therefrom.

Handle 10 has the shape and configuration of an actual tennis racket grip and may be provided in a multiplicity of conventional sizes, say 4½, 4⅝ and 4½ in terms of outer circumference.

Handle 10 is provided with a central through bore 12, through which a longitudinally extending shaft 14 of smaller diameter than bore 12 is extendable.

Shaft 14 is held in a desired position centrally of the bore by means of a pair of collars, each of which is held in position relative to handle 10 as by pins or the like, not shown one being a shaft slide collar 16 located inwardly of the lower extremity of the handle and one being a neck slide collar 18 located inwardly of the upper extremity of the handle.

The slide collars 16 and 18 are suitably provided with central bores through which the shaft extends in manner so as to be normally frictionally embraced by the slide collars.

Handle 10 is constituted by a foamed sponge elastomer or equivalent having the common property of being softer than the material of the circumscribed shaft, contemplated to be made of a suitable metal or hard plastic.

I have discovered that foamed sponge elastomers and particularly such elastomers which have certain physical properties within a carefully selected range, are highly desirable material for forming the grip member of the device. The foamed elastomer compositions espceially useful in my invention have a hardness within the range where they are capable of noticeable deformation at the pressure of the grip when, if correctly used, the muscles of the upper extremeties will cause the carpel, metacarpel, and phalanges bones of the wrist and fingers to apply force through the soft tissues and skin causing a deformity of the compressible foamed elastomer at the point of the applied force, which deformity will be such as to embrace the shaft 14 and thus prevent any slippage thereof.

A preferred material for use in this invention is neoprene foam rubber. The term neoprene is a generic one which denotes a synthetic rubberlike polymer made by polymerizing chloroprene (2-chlorol-1, 3-butadiene), or by polymerizing a mixture of polymerizable monomers, the major component of which is chloroprene. By common usage the term has been broadened to include commercial rubberlike compounds of which the major elastomeric constituent is neoprene.

Shaft 14 may be provided in various strength development indication sizes with respect to diameter, such sizes being delineated such as light, medium and heavy. For example, the thinner diameter would necessitate a greater squeeze strength acting upon the handle, forcing it to have to move through a greater distance in order to hold the shaft in its set position.

An enlarged stop knob 20 integral with shaft 14 or secured thereto is provided at the lowermost terminus of the shaft and is normally spaced from shaft slide collar 16 by as much as one-half or three-fourth inch.

Plastic neck 30 has much the same squared off configuration of the conventional racket neck and is provided with a central through bore 32 delineated hereinafter as storage space 32.

The inboard or lower extremity of the neck is provided with an integral narrowed neck extension 34 which extends longitudinally outwardly away from the neck and has a threaded central through bore 36 coaxially aligned and communicating with bore 32.

The upper extremity of shaft 14 is suitably threaded for threaded interengagement with neck extension 34 when the device is assembled for operational use. When the device is disassembled, shaft 14 may be removed from within handle 10 by the turning of stop knob 20 and if desired may be stored within storage space 32 of neck 30 wherefor the handle may be easily carried apart in one's pocket or purse and can be readily used at any convenient time purely as a forearm grip strength builder.

A player will grasp the handle or grip by placing his four fingers in the usual positions on one side of the handle and his thumb on the opposite side and with the heel of his hand properly spaced from the thumb so as to thus grip the racket in proper position for a forehand stroke with the racket. Or he may commence with the proper position for the backhand grip, or he may switch thereto by shifting his hand slightly forwardly on the handle, place his thumb in the normal position of the backhand grip, move the heel of this hand to its normal position and shift his fingers to the proper position.

In operational use, it will be understood that shaft 14 and thus neck 30 secured thereto will be frictionally held with respect to handle 10 by means of shaft slide collar 16 and neck slide collar 18 until such moment as the telltale feature of the device is exploited as the result of the centrifugal force of a player's actual stroke motion.

When the trainee, in an actual stroke motion, fails to squeeze handle 10 with a sufficient degree of force and at the appropriate moment in the stroke, shaft 14 will be allowed to move in an outboard direction, overcoming the frictional resistance of the shaft and neck slide collars, and to thrust forwardly until being brought to an abrupt and sudden stop with a crackling sound effect upon the abutment of stop knob 20 against shaft slide collar 16, thereby signalling to the player the improperness of his stroke technique.

In the training program envisioned herewith, if one does not squeeze the grip with the necessary force during the appropriate time in the stroke, the handle of the grip does not impinge upon the shaft, causing it to be immobilized. Thus, the plastic shaft portion will snap out from its friction-held position with a resounding "click" as the stop knob hits against the shaft slide collar, alerting one to improper stroke technique.

It is not intended to limit the present invention to the details of illustration or terms of description of the single preferred embodiment of the present invention set forth above, for it will be appreciated by those skilled in the art that various modifications and alterations therein may be made within the scope of the present invention.

I claim:

1. A tennis training aid comprising the combination of:

a shaft, an elongated hollow resilient grip member having a longitudinal central opening loosely enclosing said shaft, an elongated neck member axially aligned with and normally disposed closely adjacent one end of said grip member, a neck extension extending outwardly from one end of said neck member and loosely extending into said central opening of the grip member, one end of said shaft fixedly being engaged with said neck extension, a shaft slide collar fixed within said central opening adjacent the other end of said grip member and encircling said shaft for sliding engagement therewith, a neck extension slide collar fixed within said central opening and encircling said neck extension, and a stop knob, said stop knob being fixedly engaged with the other end of said shaft and spaced from said shaft slide collar when in a normal position, said grip member being deformable to a position of embracement about said shaft when and as a user grips said grip member with proper pressure during simulation of any of the usual stroke motions in a tennis game, said grip member moving away from its position of embracement about said shaft when improper pressure is applied thereto, wherefore said shaft and said neck extension slide relative to their respective collars and said neck member moves from its normal position closely adjacent said end of said grip member to a position wherein it is spaced therefrom to give a visual signal to a user that a proper degree of grip firmness has not been attained, with said stop engaging said shaft collar and emitting a sound on contact therewith to give an audible signal to a user that a proper degree of grip firmness has not been attained.

* * * * *